United States Patent [19]

Möller et al.

[11] 4,205,961

[45] Jun. 3, 1980

[54] PROCESS OF PRODUCING A NATURAL GAS SUBSTITUTE

[75] Inventors: Friedrich-Wilhelm Möller, Friedrichsdorf; Wolf D. Müller, Frankfurt am Main; Heinz Jockel, Büttelborn, all of Fed. Rep. of Germany

[73] Assignee: Metallgesellschaft, Frankfurt am Main, Fed. Rep. of Germany

[21] Appl. No.: 918,544

[22] Filed: Jun. 23, 1978

[30] Foreign Application Priority Data

Jul. 2, 1977 [DE] Fed. Rep. of Germany ..... 2729921

[51] Int. Cl.[2] ..... C10K 3/04

[52] U.S. Cl. ..... 48/197 R; 48/206; 48/215; 252/466 J; 260/449.6 M

[58] Field of Search ..... 48/197 R, 202, 206, 48/215; 260/449 M, 449.6 M; 252/466 J, 373; 201/38

[56] References Cited

U.S. PATENT DOCUMENTS

| | | | |
|---|---|---|---|
| 3,549,556 | 12/1970 | Dienes | 252/466 J |
| 3,854,895 | 12/1974 | Muller | 48/197 R |
| 3,865,753 | 2/1975 | Broecker | 260/449 M |
| 3,904,389 | 9/1975 | Banquy | 260/449 M |
| 3,947,381 | 3/1976 | Campbell et al. | 252/466 J |
| 3,967,936 | 7/1976 | Tajbl et al. | 260/449 M |
| 3,988,262 | 10/1976 | Anderson et al. | 260/449 M |
| 3,988,263 | 10/1976 | Hansford | 260/449 M |
| 4,016,189 | 4/1977 | Muller et al. | 48/197 R |
| 4,028,067 | 6/1977 | Gent | 260/449 M |
| 4,130,575 | 12/1978 | Jorn | 260/449 M |

*Primary Examiner*—Richard V. Fisher
*Assistant Examiner*—Peter F. Kratz

[57] ABSTRACT

An improvement in the production of a natural gas substitute comprising at least about 80% of methane by volume by multi-stage methanation of a synthesis gas containing hydrogen and oxides of carbon over fixed-bed nickel-containing catalysts under a pressure of about 5 to 100 bars. The starting synthesis gas, preferably produced by oxygen and water gasification of coal, has about 8 to 25% by volume of methane on a dry basis. It is methanated in a first stage at an inlet temperature of about 230°–400° C. and an outlet temperature of about 550° to 750° C. and then in a second stage at about 230° to 500° C. The process is economical with respect to heat consumption and equipment cost.

3 Claims, 2 Drawing Figures

PROCESS OF PRODUCING A NATURAL GAS SUBSTITUTE

Figure 1:
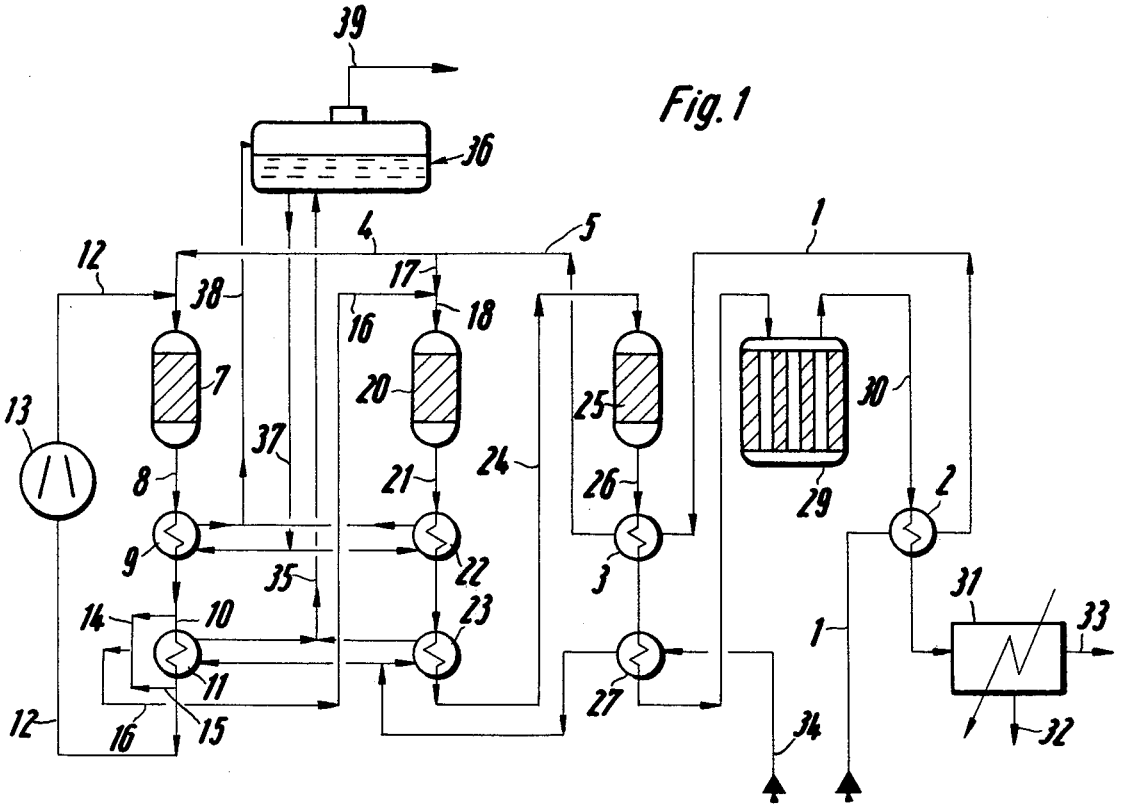

This invention relates to a process for producing a natural gas substitute comprising at least about 80% methane from a synthesis gas which contains hydrogen and oxides of carbon by a multi-stage methanation on fixed-bed nickel catalysts under pressures of 5 to 100 bars.

In a known multi-stage methanation process described in U.S. Pat. No. 4,016,189 corresponding to Printed German application 2 436 279, the synthesis gas is methanated in a plurality of stages at temperatures in the range of 200° to 500° C. over known nickel catalysts, such methanating processes hereinafter being referred to as low-temperature methanations.

It is an object of the invention to methanate a synthesis gas which has a certain initial methane content. That synthesis gas may already have been conditioned by a shift conversion in which CO and $H_2O$ have been converted to $CO_2$ and $H_2$.

This object is realized in accordance with the present invention by first methanating a synthesis gas with a methane content of about 8 to 25% by volume on a dry basis in a high-temperature of about 230° to 400° C. at the entrance to the catalyst bed therein and of about 550° to 750° C. at the exit from the catalyst bed, producing a high-methane effluent gas. This gas from the high-temperature methanating stage is subsequently subjected to a low-temperature methanation at a temperature of about 230° to 500° C.

In the high-temperature methanating stage, the temperature is in the range of about 230° to 400° C., preferably in the range of about 250° to 370° C., in the entrance region of the catalyst bed and about 550° to 750° C., preferably about 580° to 680° C., in the exit region of the catalyst bed. The known low-temperature methanating stage is generally operated at temperatures of about 230° to 320° C., preferably about 260° to 300° C., in the entrance region of the catalyst bed, and of about 260° to 500° C., preferably below about 480° C., in the exit region of the catalyst bed.

When a catalytic synthesis of methane is carried out on a commercial scale, consideration must be given to the fact that the reactions $$CO+3H_2 \rightarrow CH_4+H_2O$$

$$CO_2+4H_2 \rightarrow CH_4+2H_2O \text{ and}$$

$$CO+H_2O \rightarrow CO_2+H_2$$

are highly exothermic. To minimize the need for cooling, the methanation is desirably effected in such manner that the gas has a relatively high temperature at the exit from the catalyst bed. Such high-temperature methanation must be succeeded by a low-temperature methanation in order to obtain a product gas having the desired high methane content.

The high-temperature methanation is desirably effected in at least two reactors operated under adiabatic conditions. Each reactor is fed with part of the fresh synthesis gas and said synthesis gas is mixed with cooled effluent gas from one of the reactors. Part of the effluent gas from the first high-temperature methanating reactor may be compressed and recycled to said reactor. In an alternative, part of the effluent gas from the second or last high-temperature methanating reactor is compressed and recycled to the first high-temperature methanating reactor.

This high-temperature methanation stage is suitably fed with a synthesis gas which has a methane content of about 10 to 20% by volume on a dry basis. A synthesis gas having such methane content can be produced by gasifying coal, tar or heavy residue oils with oxygen and water vapor under superatmospheric pressure, cooling the hot gas thereby produced and purifying it to remove catalyst poisons, particularly sulfur compounds. The methanation of this synthesis gas may be preceded by a partial shift conversion.

Such methane-containing synthesis gas may be desirably produced by the known pressure gasification of coal. Details of the Lurgi pressure gasification of coal have been described in U.S. Pat. Nos. 3,930,811; 3,290,872; 3,937,620; 3,951,616; 4,031,030; and 4,014,664.

For high-temperature methanation, it is important that the nickel catalyst used for that purpose is stable and remains active at the high effluent gas temperatures. A suitable nickel catalyst comprises about 25–50% by weight of nickel, at least about 5% by weight of high-alumina cement, and at least about 5% by weight of zirconium dioxide or titanium dioxide. Such high-temperature methanation catalysts can be produced in various ways.

A first embodiment of a desirable catalyst contains the compounds $Ni_5MgAl_2O_9$ and $ZrO_2$ in a weight ratio of about 13:1 and also a high-alumina cement amounting to about 30% of the total weight of the catalyst. (The high-alumina cement has the following approximate composition in % by weight: 26.5 CaO; 71.9 $Al_2O_3$; 0.2 $Fe_2O_3$; 0.2 MgO; 0.4 $Na_2O$; 0.07 $SiO_2$ and traces of K, Cr, Cu, Mn, Ni and Pb.) The catalyst according to this embodiment is produced as follows:

Solution I is added to suspension I within 15 minutes. The suspension and solution have the following compositions:

Suspension I 1250 grams sodium carbonate in 6 liters water containing 37.5 grams $ZrO_2$ Solution I 250 grams $Mg(NO_3)_2.6H_2O$ 1280 grams $Ni(NO_3)_2.6H_2O$ 690 grams $Al(NO_3)_3.9H_2O$ in 6 liters water The resulting deposit consisting of $Ni_5Mg(OH)_{16}.CO_3.4H_2O$ on zirconium dioxide is filtered off, washed to be free from alkali, dried at 100° C. for 12 hours and then calcined at 400° C. for 4 hours. The resulting calcine thus contains nickel oxide and magnesia, alumina and zirconia as support constituents. 350 grams of the calcine are mixed under dry conditions with 150 grams of high-alumina cement. After an admixture of 60 grams water, the mixture is compacted to form tablets of 3×3 mm, which are then shortly watered and kept in a moist state in a closed system at 40° C. for 6 days to effect a complete setting. The tablets then have a face crushing strength of 464 kg/cm$^2$ and a bulk density of 1.57 kg/l. The nickel content, expressed as nickel oxide, is 28.7% by weight. Before the catalyst is used, it is reduced. This can be effected by a treatment with hydrogen or other reducing gases.

A second embodiment of a desirable catalyst contains the compounds $Ni_5MgAl_2O_9$, $ZrO_2$ and alpha-$Al_2O_3$ in a weight ratio of about 12:1:2, and also the high-alumina cement described hereinabove in about 15% of the total weight of the catalyst. The catalyst of this second embodiment is as follows:

Solutions I and III are continuously added to suspension II at a temperature of 60° C. in such manner that the pH value of the solution does not drop below 8.5. The solutions and the suspension are composed as follows:

Solution II 1250 grams sodium carbonate in 6 liters water

Solution III 255 grams $Mg(NO_3)_2.6H_2O$
1280 grams $Ni(NO_3)_2.6H_2O$
690 grams $Al(NO_3)_3.9H_2O$ in 6 liters water Suspension II 43.2 grams zirconium dioxide and 74.0 grams alpha-$Al_2O_3$ in 3 liters water The resulting precipitate is filtered off and the filter cake is washed and then dried at 110° C. for 12 hours and subsequently calcined at 400° C. for 4 hours.

425 grams of the resulting calcine are mixed with 75 grams high-alumina cement in a dry state. After an admixture of 75 grams of water, the mixture is compacted to form 3×3 mm tablets. The finished catalyst is shortly watered and then dried at 110° C. for 12 hours. The resulting catalyst has a face crushing strength of 453 kg/cm and a bulk density of 1.52 kg/l. The nickel content, expressed as nickel oxide, is 30.3% by weight. The catalyst is reduced before it is used.

A desirable catalyst of a third embodiment contains the compounds $Ni_6Al_2O_9$ and $TiO_2$ in a weight ratio of about 7:2 and also contains high-alumina cement amounting to about 20% of the total weight of the catalyst. The catalyst is produced as follows:

Solutions IV and V and suspension III are produced first. They are composed as follows:

Solution IV 1909 kg sodium carbonate in 6 liters water

Solution V 1745 kg $Ni(NO_3)_2.6H_2O$
750 kg $Al(NO_3)_2.9H_2O$ in 6 liters water Suspension III 57 grams $TiO_2$ in 3 liters water Solutions IV and V are added to suspension III at 60° C. and at a pH value not less than 8. The resulting precipitate is filtered off, washed to be free from alkali, dried at 110° C. for 12 hours and finally calcined at 400° C. for 4 hours.

400 grams of the resulting calcine are mixed in a dry state with 100 grams of high-alumina cement. After an admixture of 150 grams water, the mixture is compacted to form 3×3 mm tablets, which are shortly watered and then treated at 110° C. for 12 hours. The resulting catalyst has a face crushing strength of 463 kg/cm$^2$ and a bulk density of 1.53 kg/l. The nickel content, expressed as nickel oxide, is 41.3% by weight. The catalyst is subsequently reduced.

Figure 2:
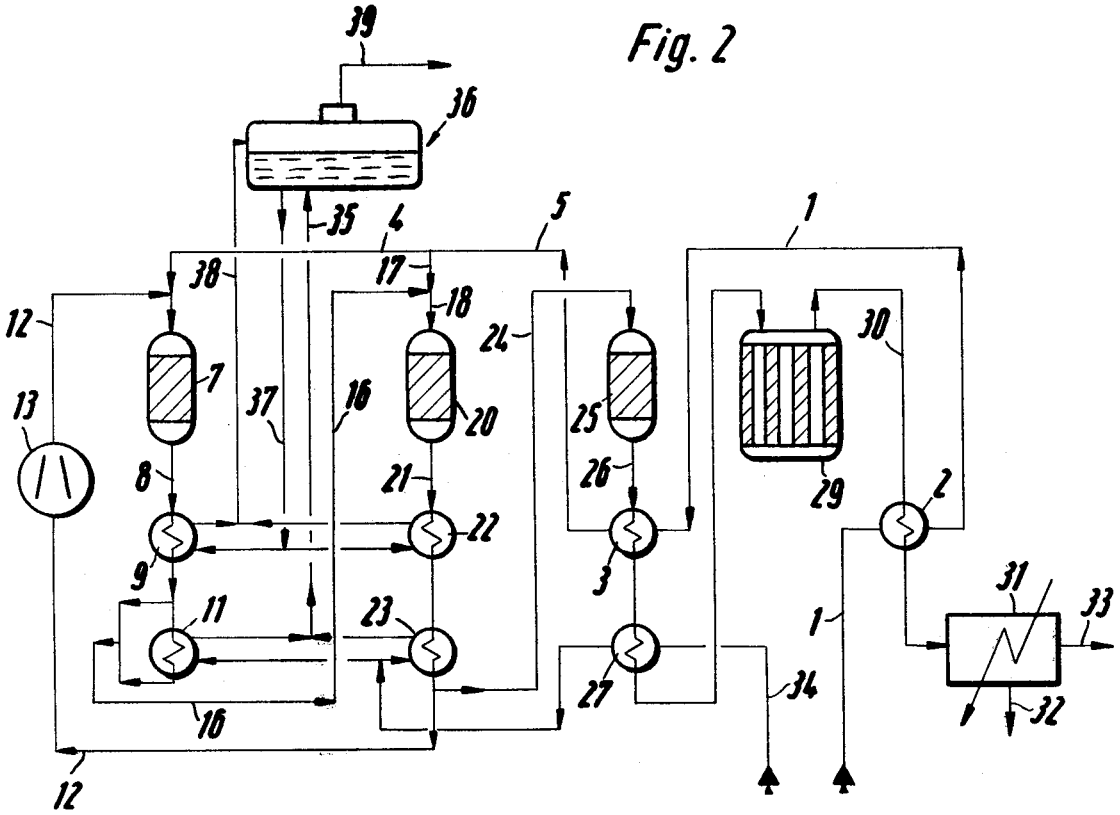

Embodiments of the process according to the invention will be explained with reference to the drawing, in which FIG. 1 shows a first embodiment of a synthesis gas methanating plant comprising high-temperature and low-temperature methanating stages and FIG. 2 shows a modification of the embodiment illustrated in FIG. 1.

In the process illustrated in FIG. 1 a synthesis gas which has been purified to be free from catalyst poisons and which contains mainly carbon monoxide and hydrogen and some methane is fed to the heat exchanger 2 in conduit 1. The synthesis gas comes from a scrubber, which is not shown and in which mainly sulfur compounds have been removed. The synthesis gas is at a temperature below 200° C., usually at most 100° C. When the gas has been scrubbed with liquid methanol in the known Rectisol process, the gas has a temperature of about 20° C.

The synthesis gas is then preheated as it flows through the heat exchanger 3 which it leaves through conduit 5. The preheating of the gas is controlled so that the mixed gases are at a temperature of 230° to 400° C., preferably 250° to 370° C., as they enter the high-temperature methanating reactors 7 and 20.

60 to 80% of the entire gas flowing in conduit 5 enters conduit 4 and, before entering the reactor 7, is mixed with recycled effluent gas from conduit 12. The effluent gas from reactor 7 flows in conduits 8 and 10 and has been cooled in the waste heat boiler 9 and the economizer 11 and compressed by the blower 13. The ratio of the gases flowing in conduits 12 and 4 are in the range from about 0.5:1 to 3:1 and preferably about 0.8:1 to 2:1 by volume.

The methanation catalyst for the high-temperature methanation in the reactors 7 and 20 contains nickel as an active component. The catalyst is arranged in a fixed bed in the reactors, which are operated under adiabatic conditions.

The heat which is extracted from the effluent gas in the waste heat boiler 9 is used to produce water vapor, which is fed to the steam-collecting drum 36 through conduit 38. The steam-collecting drum 36 is also fed with preheated water from economizers 11 and 23 through conduit 35. The water in drum 36 is fed to the waste heat boilers 9 and 22 through conduit 37. Surplus steam is withdrawn from the steam-collecting drum 36 through conduit 39. This steam may be used, e.g. as a gasifying agent in the pressure gasification of solid or liquid fuels to produce the synthesis gas.

Part of the effluent gas flowing in conduit 10 is cooled in the economizer 11. Effluent gas which is not cooled is branched off into conduit 14. Part of the cooled effluent gas flowing in conduit 12 is recycled by means of the blower 13, as has already been mentioned. Behind the waste heat boiler 11, a partial stream of effluent gas is withdrawn through conduit 15 and is admixed with the partial stream flowing in conduit 14. The resulting mixed gases are mixed in conduit 16 with the raw gas flowing in conduit 17. The mixed gases flowing in conduit 18 are fed to the second high-temperature methanating reactor 20. The inlet temperatures are in the same range as with reactor 7.

The reactor 20 may contain the same nickel catalyst for high-temperature methanation as reactor 7. The temperatures of the effluent gas at the end of the catalyst bed in reactor 20 and in conduit 21 are in the range from 550° to 750° C., preferably 580° to 680° C. The effluent gas flowing in conduit 8 is at the same temperatures.

Part of the sensible heat of the effluent gas flowing in conduit 21 is extracted in the waste heat boiler 22 and the economizer 23. The gas is cooled to such an extent that the temperature in the exit region of the nickel catalyst of the succeeding low-temperature methanation reactor 25 is 400° to 500° C. Low temperature nickel catalysts have been known for a long time. They are used at operating temperatures of about 230° to 500° C.

The effluent gas flowing in conduit 26 is cooled in heat exchanger 3. Heat of the effluent gas is also utilized in the economizer 27 for heating feed water from conduit 34. The effluent gas from reactor 25 does not yet have the desired final composition and for this reason must be subjected to a catalytic final methanation at a lower temperature in accordance with known laws of thermodynamics. A countercurrent cooling reactor 29 as described in U.S. Pat. No. 4,016,189 may be used for this purpose. The two reactors 25 and 29 containing fixed beds of nickel catalyst constitute the low-temperature methanating stage.

The moist product gas leaving the reactor 29 through conduit 30 is at a temperature of 260° to 500° C., preferably below 480° C., and is cooled in heat exchanger 2. The latter is succeeded by a cooling stage 31, which suitably comprises a water cooler and an air cooler. Condensate is removed at 32. The product gas which becomes available in conduit 33 is a natural gas substitute.

FIG. 2 shows a methanating plant which is similar to that of FIG. 1 except that the recycled gas flowing in conduit 12 is withdrawn behind the economizer 11 in the arrangement of FIG. 1 but comes from the economizer 23 in the arrangement of FIG. 2. In the arrangement of FIG. 2, only 40 to 60% of the raw gas flowing in conduit 5 is fed through conduit 4 to the first high-temperature methanating reactor 7.

These differences are of considerable significance. In the arrangement of FIG. 1, more gas is recycled in conduit 12 and a lower pressure differential must be overcome by the blower 13. For this reason a simpler and less expensive blower 13 may be used in the arrangement of FIG. 1 than in the arrangement of FIG. 2. For this reason the blower 13 in FIG. 1 is more reliable in operation although it costs only one-half as much as the blower in FIG. 2. This amounts to a saving of about 4 to 6% of the costs of the entire plant.

The invention is further described in the following illustrative examples:

EXAMPLE

By a pressure gasification of coal, modified by a partial shift conversion and fed through a Rectisol scrubber, there are obtained 1000 kilomoles of synthesis gas having the following main components:

| | |
|---|---|
| $CO_2$ | 1.48 mole percent |
| CO | 18.60 mole percent |
| $H_2$ | 63.14 mole percent |
| $CH_4$ | 16.21 mole percent |

For a comparison, this gas is subjected to methanation in accordance with FIG. 1 and in accordance with FIG. 2.

Synthesis gas at 18° C. is fed in conduit 1 to heat exchanger 2 and heated therein at 220° C./220° C. (FIG. 1/FIG. 2). The gas is preheated to 315° C. in heat exchanger 3. 750 kilomoles of synthesis gas are fed in conduit 4 to reactor 7. 1050 kilomoles/625 kilomoles of moist recycled gas coming from the compressor 13 and having a temperature of 290° C./290° C. are admixed in conduit 12. The composition of the gas flowing in conduit 12 is given in Table 1:

Table 1

| | | FIG. 1 | FIG. 2 |
|---|---|---|---|
| $CO_2$ | (mole percent) | 5.14 | 5.11 |
| CO | " | 3.29 | 2.28 |
| $H_2$ | " | 32.29 | 29.24 |
| $CH_4$ | " | 58.95 | 63.01 |
| Others | " | 0.33 | 0.36 |
| $H_2O$ | (moles per mole of dry gas) | 0.2529 | 0.2843 |

The recycled gases are mixed with the partial streams of synthesis gas so that 1800 kilomoles/1145 kilomoles of moist gas at 300° C. are fed to the reactor 7. The composition is indicated in Table 2:

Table 2

| | | FIG. 1 | FIG. 2 |
|---|---|---|---|
| $CO_2$ | (mole percent) | 5.14 | 5.11 |
| CO | " | 10.52 | 10.70 |
| $H_2$ | " | 46.87 | 46.72 |
| $CH_4$ | " | 38.75 | 38.87 |
| Others | " | 0.44 | 0.47 |
| $H_2O$ | (moles per mole of dry gas) | 0.1349 | 0.1376 |

The mixed gases having the composition indicated in Table 2 are reacted in high-temperature methanation reactor 7 and are at a temperature of 650° C. when leaving the reactor. The gas leaving the reactor in conduit 8 has the composition indicated in Table 3:

Table 3

| | | FIG. 1 | FIG. 2 |
|---|---|---|---|
| $CO_2$ | (mole percent) | 5.14 | 5.14 |
| CO | " | 3.29 | 3.29 |
| $H_2$ | " | 32.39 | 32.29 |
| $CH_4$ | " | 58.94 | 58.94 |
| Others | " | 0.34 | 0.34 |
| $H_2O$ | (moles per mole of dry gas) | 0.2559 | 0.2559 |

The absolute quantity of gas flowing in conduit 8 amounts to 1570 kilomoles/995 kilomoles of moist gas. This gas is cooled further in the waste heat boiler 9 and the economizer 11. 520 kilomoles/995 kilomoles of gas at 285° C./295° C. are mixed in conduit 16 with 250 kilomoles/480 kilomoles of synthesis gas from conduit 17. 770 kilomoles/1475 kilomoles of moist gas which is at 300° C. and has the composition indicated in Table 4 is fed to the reactor 20:

Table 4

| | | FIGs. 1 and 2 |
|---|---|---|
| $CO_2$ | (mole percent) | 3.76 |
| CO | " | 9.08 |
| $H_2$ | " | 43.97 |
| $CH_4$ | " | 42.77 |
| Others | " | 0.42 |
| $H_2O$ | (moles per mole of dry gas) | 0.159 |

675 kilomoles/1300 kilomoles of moist gas which has been reacted over the high-temperature methanation catalyst in reactor 20 are withdrawn from the latter. In the reactors 7 and 20 operated under adiabatic conditions, the "first embodiment" of catalyst as described hereinabove is arranged in a fixed bed. The composition of the gas leaving the reactor 20 is indicated in Table 1. The composition of the gas flowing in conduit 21 of the arrangement of FIG. 1 is indicated in Table 5:

Table 5

| | | |
|---|---|---|
| $CO_2$ | (mole percent) | 5.11 |
| CO | " | 2.28 |
| $H_2$ | " | 29.22 |
| $CH_4$ | " | 63.01 |
| Others | " | 0.18 |
| $H_2O$ | (moles per mole dry gas) | 0.2843 |

675 kilomoles of moist gas leave the reactor 20 and are subjected to low-temperature methanization. That gas is cooled to 290° C. in units 22 and 23 and then fed to the methanation reactor 25. 620 kilomoles of moist gas at 465° C. are withdrawn from the reactor 25. This gas has the composition indicated in Table 6:

Table 6

| | | FIGS. 1 and 2 |
|---|---|---|
| $CO_2$ | (mole percent) | 2.70 |
| CO | " | 0.12 |
| $H_2$ | " | 13.52 |
| $CH_4$ | " | 83.23 |
| Others | " | 0.43 |
| $H_2O$ | (moles per mole of dry gas) | 0.4452 |

The effluent gas from the intermediate methanation reactor is cooled in heat exchangers 3 and 27 to the gas inlet temperature of 195° C. of reactor 29. The final methanation in the countercurrent cooling reactor is effected under identical conditions in both embodiments of the process because the gas rates, inlet temperatures and gas outlet temperatures, amounting to 270° C., are the same. In the reactors 25 and 29, which are operated under adiabatic conditions, the nickel catalysts are arranged in a fixed bed and contain 58% by weight of nickel on an alumina support.

The moist product gas flowing in conduit 30 in an amount of 600 kilomoles has the following composition:

| | | |
|---|---|---|
| $CO_2$ | (mole percent) | 0.33 |
| CO | " | 0.00069 |
| $H_2$ | " | 3,94 |
| $CH_4$ | " | 95.26 |
| Others | " | 0.47 |
| $H_2O$ | (moles per mole of dry gas) | 0.5492 |

The product gas flowing in conduit 30 is cooled to 40° C. in heat exchanger 2 and the succeeding cooling stage 31. This results in the condensation of about 3800 kg of process water. Constituting a natural gas substitute, the product gas is dried and then compressed to 64 bars before it is delivered to consumers.

It will be appreciated that the instant specification and examples are set forth by way of illustration and not limitation and that various modifications and changes may be made without departing from the spirit and scope of the present invention.

What is claimed is:

1. In the production of a natural gas substitute comprising at least about 80% of methane by volume by multi-stage methanation of a synthesis gas containing hydrogen and oxides of carbon over fixed-bed nickel-containing catalysts under a pressure of about 5 to 100 bars, the improvement which comprises employing a synthesis gas having a methane content on a dry basis of about 8 to 25% by volume, effecting methanation in a first catalyst-containing stage wherein the gas has a temperature of about 230° to 400° C. at the entrance to the catalyst therein and a temperature of about 550° to 750° C. at the exit from the catalyst, said first stage comprising at least two adiabatically operating methanation reactors in sequence, each reactor being fed with part of the fresh synthesis gas, the first reactor being fed with a mixture of fresh synthesis gas and a recycled part of an effluent gas from one of the reactors, said part of the effluent gas being cooled and compressed, from the last reactor withdrawing a high-methane effluent gas and then effecting further methanation of the high-methane effluent gas in a second catalyst-containing stage at a temperature of about 230° to 500° C., thereby to produce a gas comprising at least about 80% of methane by volume, the catalyst in the reactors of said first stage by weight consisting essentially of about 25–50% of nickel, about 30% of high-alumina cement and at least about 5% of zirconium dioxide, the nickel being present as the compound $Ni_5MgAl_2O_9$ which compound is present in about 13 times the weight of zirconium dioxide.

2. A process according to claim 1, wherein the synthesis gas supplied to the first methanation stage has a methane content of about 10 to 20% by volume on a dry basis.

3. A process according to claim 1, wherein the synthesis gas is produced by gasification of coal, tar or heavy residue oil with oxygen and water vapor under superatmospheric pressure, cooling the resulting hot gas, and purifying such gas to remove catalyst poisons.

* * * * *